United States Patent [19]

Claiborne

[11] 4,447,243

[45] May 8, 1984

[54] ODOR SCAVENGING SYSTEM

[75] Inventor: J. Lyle Claiborne, Hixson, Tenn.

[73] Assignee: Dixie Yarns, Inc., Chattanooga, Tenn.

[21] Appl. No.: 527,225

[22] Filed: Aug. 29, 1983

Related U.S. Application Data

[63] Continuation of Ser. No. 293,095, Aug. 17, 1981, abandoned.

[51] Int. Cl.[3] ..... D06M 13/34

[52] U.S. Cl. ..... 8/188; 8/918; 8/919; 8/606; 424/76

[58] Field of Search ..... 8/188; 424/76

[56] References Cited

U.S. PATENT DOCUMENTS

| | | | |
|---|---|---|---|
| 2,837,462 | 6/1958 | Morin | 424/290 |
| 2,979,157 | 4/1961 | Clark | 427/339 |
| 3,325,402 | 6/1967 | Erskine | 424/25 |
| 3,419,562 | 12/1968 | Wakeman et al. | 8/128 R |
| 3,673,110 | 6/1972 | Edwards | 8/188 |
| 3,694,364 | 9/1972 | Edwards | 8/188 |
| 3,817,702 | 6/1974 | Paulus et al. | 8/120 |
| 4,035,145 | 7/1977 | Gipp et al. | 8/188 |
| 4,065,257 | 12/1977 | Coe et al. | 8/602 |
| 4,149,849 | 4/1979 | Koch et al. | 8/918 |
| 4,331,441 | 5/1982 | Dvorsky et al. | 8/606 |
| 4,333,183 | 6/1982 | Popper | 424/76 |
| 4,374,639 | 2/1983 | Claiborne | 8/137 |
| 4,380,453 | 4/1983 | Claiborne | 8/606 |

OTHER PUBLICATIONS

A Rohm & Haas brochure dated Aug. 1982, entitled "Hyamine ® 1622 Microbicide.

A Rohm & Haas brochure dated Oct. 1981, entitled "Hyamine ® 2389 Germicide (EPA Reg. No. 707–49).

A Rohm & Haas Memo, dated 7/29/47, entitled "Deodorizing Properties of Hyamine ® 1622".

"Dyeing with Direct and Fiber Reactive Dyes" Textile Chemist and Colorist, Michel Rupin, vol. 8, No. 9, pp. 139–143.

*Primary Examiner*—A. Lionel Clingman

*Attorney, Agent, or Firm*—Parkhurst & Oliff

[57] ABSTRACT

A system for eliminating odors by using an odor scavenger member having a textile substrate or the like impregnated with odor scavenging materials such as N-trisubstituted ammonium-2-hydroxy-3-halopropryl compounds or salts of epoxy propyl ammonium compounds such as glycidyltrimethylammonium chloride. Such members, and the methods of making and using same are included.

11 Claims, No Drawings

ODOR SCAVENGING SYSTEM

This is a continuation of application Ser. No. 293,095 filed Aug. 17, 1981 now abandoned.

BACKGROUND

The present invention relates to a system for removing undesirable odors found in the air. More particularly, this invention relates to an odor scavenger material for use in refrigerators, air conditioners, or the like. A very common problem faced today is that of the odiferous refrigerator. When pungent foods such as onions, leftovers, canalope, fish, very strong cheeses, or the like, are left in a refrigerator, the refrigerator often takes on a rather offensive odor which invades the kitchen once the refrigerator is opened. A rather typical solution to the problem of an odiferous refrigerator is that of placing an opened box of baking soda in the refrigerator.

Of course there are many other closed environments in which undesirable odors may proliferate or be contained without ventilation or adsorption of the odors. The present invention is useful in such closed environments also.

Another common problem is that of an air conditioner wherein foul smelling air is recirculated throughout the room. Most air conditioner filters are only designed to remove dust or other particles of similar size from the air. To accomplish this, a typical filter might be made out of strands of material such as fiberglass. While such filters are useful in removing dust-size particles, they do not help to remove odors.

The present invention seeks to solve these and other problems by utilizing quaternary ammonium compounds in a new way.

The quaternary ammonium compounds per se, are known, as indicated in Rupin, Michiel, "Dyeing with Direct and Fiber Reactive Dyes," *Textile Chemist and Colorist,* Volume 8, No. 9, September, 1976, pages 1-9/-54-143/58, and the references cited therein, such as U.S. Pat. No. 2,131,120; British Pat. No. 971,958; French Pat. No. 1,490,066; French Pat. No. 1,598,218; French Pat. No. 2,041,703; French Pat. No. 2,061,533; and French Pat. No. 2,096,702. Until now, such compounds have been used to improve dyeing efficiency and improve direct dyefastness for cellulose fabrics. However, the prior art does not suggest the use of such compounds as odor scavengers.

BRIEF SUMMARY OF THE INVENTION

It is, therefore, an object of this invention to provide a novel odor scavenging system.

It is another object of this invention to provide a novel odor scavenging member.

It is another object of this invention to provide a simple and economical system for eliminating odors from refrigerators or, more generally, from the air.

It is another object of this invention to provide a simple, economical system for eliminating undesirable odors from any closed environment.

The foregoing objects and others are accomplished in accordance with the present invention wherein an odor scavenger member comprising a substrate, for example a textile substrate, impregnated with a quaternary ammonium compound such as gylcidyltrimethylammonium chloride is wetted and used in air, wherein the odor scavenger member serves to adsorb any undesirable odors from the air.

DETAILED DESCRIPTION

The odor preventing member of the present invention comprises two basic elements: first, a substrate, and second, an odor scavenging substance which is applied to or impregnated in the substrate.

The substrate of the odor scavenging member of the present invention may take any desirable form, and may comprise any desirable material. The substrate might typically be a textile material, preferably cellulosic textile material. That textile material may take virtually any form, such as a woven, non-woven, or knitted fabric, a braided rope or ball, or any other desirable configuration. Even paper-like substrates may be used. The purpose of the substrate is to provide a carrier for odor scavenging material, and to provide a sufficient area over which that odor scavenging material is accessible to the air in which the odor scavenging member or cloth is to be used. One particularly suitable substrate is a towel-like piece of terrycloth loop pile cotton fabric. Another particularly preferred substrate is a non-woven fabric "Novonette" available from the Kendall Co., Walpole, Mass. It will be appreciated that any substrate which may be successfully treated with an odor scavenger material may be satisfactorily used as the substrate for the odor scavenger member of the present invention.

The odor scavenging material which is applied to, adsorbed by, or impregnated into the substrate should be a material which has high affinity for odors. Quaternary ammonium compounds, and quaternary ammonium epoxy compounds may be used for this purpose. In particular, the odor scavenging material may comprise a compound of the N-trisubstituted ammonium-2-hydroxy-3-halopropyl type of the general formula:

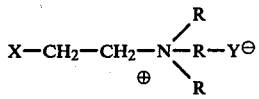

or salts of epoxy propyl ammonium (or glycidyl ammonium) components having the general formula:

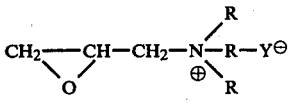

wherein X is a halogen radical, Y is an anionic group such as chloride, bromide, sulfate or sulphonate, and the R's are methyl, ethyl, butyl or benzyl groups or alcohols thereof.

A particularly preferred odor scavenging material is glycidyltrimethylammonium chloride. Glycidyltrimethylammonium chloride is commercially available under the name Glytac from Societe Protex, Levellois, France.

The odor scavenging material may be applied to a desired substrate by any suitable means or method. Typcially, a dilute aqueous solution of the odor scavenging material will be prepared, and the desired substrate material passed through a bath thereof to impregnate fully the substrate material. The odor scavenging material will preferably be present in the solution in a concentration of about 4–10% by weight. In impregnating the substrate, the amount of solution applied to the substrate is preferably about equal to the weight of the substrate, i.e. about one part by weight. The aqueous solution may contain other ingredients such as a base, like sodium hydroxide or sodium carbonate, although any suitable base should work. The solution is made "slightly alkaline" which herein means having the alkalinity provided by sodium hydroxide present in a concentration of about 0.5–40 grams per liter, or the basic equivalent thereof. A preferred alkalinity is provided by using sodium hydroxide in a concentration of about 10 gram per liter. One or more surface active agents may be added to enhance wetting of the substrate material by the odor scavenging material solution. Impregnation of substrate materials in such aqueous solutions of odor scavenging material may be conducted at any suitable temperature, but lower temperatures are preferred and impregnation is typically conducted at about room temperature. Also note previously discovered utilities of such members as disclosed, for example, in U.S. Pat. Nos. 4,374,639 and 4,380,453.

The following examples further specifically illustrate the present invention wherein the novel odor scavenging members are made and used. The parts and percentages are by weight unless otherwise indicated. These examples are intended to illustrate various preferred embodiments of the novel odor scavenging system.

EXAMPLE I

Odor scavenger solution is prepared by mixing about 40 grams of Glytac (glycidyltrimethylammonium chloride commercially available from Societe Protex, Levellois, France) with about 10 grams of sodium hydroxide, about 10 milliliters of Protowet TJ (a surface active agent available from the Proctor Chemical Company, Salisbury, N.C.), and about one liter of water. After thorough mixing of that solution, wash-cloth size pieces of white, towel-like loop pile terry cotton fabric is immersed in the solution, removed from the solution and excess solution extracted by passing the cloths through rubber wringer rolls. The cloths are then stored wet for about 12 hours. The cloths are then washed by conventional means to remove any excess solution, and then dried.

EXAMPLE II

A odor scavenger solution is prepared as in Example I, and pieces of non-woven cellulosic fabric, available under the name "Novonette" from the Kendall Company, Walpole, Mass., are treated with the solution as described in Example I.

EXAMPLE III

The odor scavenger member made according to Example I or II is wetted with water and hung in a refrigerator having undesirable odors therein. Within minutes, the foul air found in the refrigerator is unobjectionable in odor.

EXAMPLE IV

The odor scavenger member according to Example I or II is placed in an air conditioner so as to be in the flow path of the circulating air. Means are provided to keep the odor scavenger member wet from contact with water. The air leaving the air conditioner is freshened.

EXAMPLE V

The odor scavenger member made according to Example I or II is wetted with water and hung in an enclosed volume which contains foul odors. In a relatively short time the foul odors in the enclosed volume are much less objectionable.

Although specific components and proportions have been stated in the above description of the preferred embodiments of the novel odor scavenging system wherein odor scavenger material containing substrates are used, other suitable materials and minor variations in the various steps in the system as listed herein, may be used. In addition, other materials and steps may be added to those used herein, and variations may be made in the system to synergize, enhance or otherwise modify the properties of or increase the uses for the invention.

It will be understood that various other changes of the details, materials, steps, arrangements of parts and uses which have been herein described and illustrated in order to explain the nature of the invention will occur to and may be made by those skilled in the art, upon a reading of this disclosure, and such changes are intended to be included within the principle and scope of this invention.

What is claimed is:

1. A method of freshening air, comprising:

wetting an odor preventing member and placing it in a position so that odor containing air may come into contact with the surface of the odor preventing member, said member comprising a substrate material reacted with an odor preventing material, said material comprising a compound from the group consisting of:

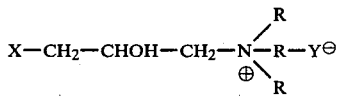

or a salt of epoxy propyl ammonium having the general formula

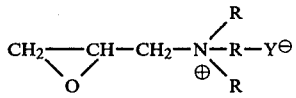

wherein X is a halogen radical, Y is chloride, bromide, sulfate or sulfonate, and the R's are methyl, ethyl, butyl or benzyl groups and hydroxyl substituted derivatives thereof.

2. The method of claim 1 wherein said substrate is a textile material.

3. The method of claim 2 wherein said substrate is a cotton fabric.

4. The method of claim 2 wherein said substrate is a cellulosic material.

5. The method of claim 4 wherein said substrate is non-woven.

6. The method of claim 1 wherein said substrate is a paper-like material.

7. The method of claim 1 wherein said odor preventing material is glycidyltrimethylammonium chloride.

8. The method of claim 1 wherein said substrate is a non-woven cellulosic material and the odor preventing material is glycidyltrimethylammonium chloride.

9. The method of claim 1 wherein said odor preventing member is placed in a refrigerator.

10. The method of claim 1 wherein said odor preventing member is placed in an air conditioner.

11. The method of claim 1 wherein said odor containing air is in an enclosed volume.

* * * * *